United States Patent [19]

Gaissmaier

[11] Patent Number: 4,881,307

[45] Date of Patent: Nov. 21, 1989

[54] EXPANSION OF SHEET MATERIALS

[75] Inventor: Rudi Gaissmaier, Lyndoch, Australia

[73] Assignee: Watership PTY. Ltd., Harrisfield, Australia

[21] Appl. No.: 67,709

[22] Filed: Jun. 29, 1987

[30] Foreign Application Priority Data

Jun. 30, 1986 [AU] Australia ..... PH06644

[51] Int. Cl.[4] ..... B21D 31/04

[52] U.S. Cl. ..... 29/6.1; 29/6.2; 29/163.6

[58] Field of Search ..... 29/6.1, 6.2, 163.6, 29/455 LM; 52/795, 799, 806, 807, 630, 670, 671; 428/256

[56] References Cited

U.S. PATENT DOCUMENTS

| | | | |
|---|---|---|---|
| 780,173 | 1/1905 | Hayes | 29/6.2 |
| 783,952 | 2/1905 | Hayes | 29/6.1 |
| 843,728 | 2/1907 | White | 29/6.1 |
| 890,126 | 6/1908 | Crittall . | |
| 895,923 | 8/1908 | White . | |
| 1,230,635 | 6/1917 | White | 29/6.1 |
| 1,321,089 | 11/1919 | Clark . | |
| 1,411,543 | 4/1922 | White | 29/6.1 |
| 1,437,746 | 12/1922 | Clark | 52/671 |
| 2,107,278 | 2/1938 | Baker | 29/6.2 |
| 3,206,536 | 9/1965 | Goodloe | 52/670 |
| 3,591,351 | 7/1971 | Ullman . | |
| 3,774,274 | 4/1973 | Jury . | |
| 3,910,092 | 10/1975 | Jury et al. | 29/6.1 |

*Primary Examiner*—Howard N. Goldberg
*Assistant Examiner*—Andrew E. Rawlins
*Attorney, Agent, or Firm*—Merchant, Gould, Smith, Edell, Welter & Schmidt

[57] ABSTRACT

A process and machine are provided for the formation of expanded mesh materials in which a slotted starting sheet is bent along at least one succession of alternate strand diagonals (1,2, 3, 4, 5; A, B, C, D), each strand (20) in any one diagonal being bent simultaneously in at least two positions in the same manner and to the same extent so that the strands (20) of the strand diagonal (1, 2, 3, 4, 5; A, B, C, D) being bent remain in substantially parallel planes during and after bending. A "strand" (20) is defined as the area of overlap between adjacent rows of slots (10) at each end of a respective slot (10) according to the slot pattern in the slotted starting sheet.

4 Claims, 5 Drawing Sheets

EXPANSION OF SHEET MATERIALS

BACKGROUND OF THE INVENTION

This invention relates to the expansion of sheet materials to produce mesh-like products which may be used for functional and/or aesthetic purposes in buildings or other applications.

There have been many prior proposals for the production of expanded mesh materials. Such prior proposals have generally involved the initial formation of a substantially planar sheet followed by the cutting of the sheet in a pattern which permits subsequent lateral expansion of the sheet into the desired mesh form. The procedures used for cutting and/or lateral expansion have resulted in the formation of substantial stresses in areas of the starting sheet and the various production parameters have led to limitations in the shape, size, pattern and other features of the prior products and hence in the uses which may be made of such products. Many prior proposals have not reached commercial realization because of the associated production difficulties or deficiencies in the end products.

Some prior proposals have involved elongation of parts of the starting sheet to form the expanded product. Other prior proposals have involved bending or twisting parts of the starting sheet. Still further prior proposals have involved a combination of several different forms of deformation of the starting sheet. Those proposals involving bending or twisting only have generally required less energy to operate and may thus be more commercially attractive than proposals requiring elongation of the starting sheet.

U.S. patent specification No. 895,923 discloses an apparatus for expanding slotted metal in which a slitted sheet is fed through a pair of stationary co-acting dies. The dies must be formed to produce the required expansion and must be complementary to the pattern of slits formed in the sheet. The expansion process proceeds continuously as the sheet is forced through the dies.

In U.S. patent specification No. 890,125 a process is described in which the junctions between the ends of the slits formed in rows in a metal sheet are twisted out of the plane of the sheet and the sheet is then expanded to enlarge the openings formed by the twisting.

U.S. patent specification No. 1,321,089 discloses a machine in which a slotted metal sheet can be expanded by passage through opposed expanding disks. The continuously expanded sheet thus formed has adjacent oppositely directed meshes separated by longitudinally extending strips of unexpanded sheet intended to strengthen the corrugated end product.

U.S. patent specification No. 843,728 discloses a machine for continuously expanded slotted sheet in which a toothed drum draws the sheet over a toothed or corrugated working edge. No indication is given how the friction between the sheet and the working edge can be controlled to produce a uniform product.

U.S. patent specification No. 780,173 discloses a machine in which pivoted bending fingers are used to expand a slotted sheet. The bending fingers act on the centre portion of strands extending between the ends of longitudinally aligned slits while the sheet is supported at the ends of these slits.

It is an object of the present invention to provide an improved process for the formation of expanded mesh materials which will allow for the production of a wide range of product forms and in which the products are made without the stresses present in many of the prior art materials. The provision of products having the characteristics of those produced by this improved process and a machine which may be used to produce such products are further objects of the invention.

The starting sheet materials used in accordance with the present invention are substantially planar in form and may be produced by known processes such as rolling or extrusion. Although simple sheets with a rectangular cross section are preferred, the invention may be applied to sheets of variable cross sectional area including sheets having fins projecting substantially from the general plane of the sheet. The invention may also be applied to sheets formed by the longitudinal or lateral folding of a sheet to form a starting material which although still basically planar in form consists of a series of folds or corrugations giving the starting sheet greater depth than the sheet material from which it is formed.

The invention is applicable to sheets having a wide range of variation in length, width and thickness but is particularly useful in the production of expanded products from sheets having considerably greater length than width and may be adapted to the continuous production of expanded mesh materials from a continuous roll of sheet material.

The invention is preferably applied to sheets of metal but any other substantially rigid but malleable material, for example thermoplastics material, may be used to form expanded meshes in accordance with the present invention.

In accordance with the invention the starting sheet material is cut in a predetermined pattern of slots or slits by removing or shearing portions of the sheet. The method by which the slots or slits are formed in the starting material is not critical to the present invention and while the term "slots" may be generally understood as referring to apertures or areas of weakness formed by the removal of portion of the starting sheet and "slits" may be understood as referring to areas where the starting material has been severed or weakened without actually removing any material from the area concerned, the term "slots" will be used in the remainder of this specification to designate any of the so formed areas. Unlike some previous proposals for the formation of expanded mesh materials, the sheet material near the ends of the slots is not subjected to any substantial stress by the process of the present invention, so that special care in the formation or shape of the slots is not required.

The pattern of slots formed in accordance with the invention comprises parallel rows each containing a plurality of slots and preferably extending in alignment with the edges of the sheet material. The alignment of the parallel rows of slots is preferably longitudinally extending but may extend transversely to the longitudinal axis of the sheet. For convenience in the following description, the rows of slots will be described as extending longitudinally and parallel with the side edges of the sheet material.

In the pattern of slots formed in accordance with the invention, each slot in any one row partially overlaps at each end with a different slot in its laterally adjacent row or rows. The slots are so formed in a pattern which is repeated regularly over the sheet.

The regularly repeated pattern forms a configuration in which an area of overlap exists between one end portion of a first slot in one row and the opposite end portion of a second slot in the next adjacent row. The other end portion of the second slot similarly overlaps with the opposite end portion of a third slot in the next adjacent row and the plurality of areas so formed extends diagonally across the longitudinal direction of the slots. For convenience of the present description, these overlapping areas are referred to as "strands" and a succession of strand diagonals may thus be considered to run roughly in parallel across the rows of slots.

The process according to the invention includes expanding the sheet by bending each alternate strand diagonal. For example, in one form of the invention, the strand diagonals may be bent out of the plane of the sheet, for instance to extend above or below a horizontal plane in which the sheet lay before bending. Alternatively, in another form of the invention, the strand diagonals may be bent within the plane of the sheet; in this case the strands are preferably bent around axes which are perpendicular to the plane of the sheet.

Preferably each alternate strand diagonal is bent in succession with all strands in any one diagonal being bent simultaneously. Every second strand diagonal may be bent in groups of two or more but the machinery required to bend groups of strand diagonals may be undesirably complex.

Each individual strand in the strand diagonal being bent is bent in at least two positions between the slots which define the sides of the strand. Each strand in each strand diagonal bent is bent in the same manner and to the same extent so that the strands of the strand diagonal being bent remain in substantially parallel planes during and after bending. If desired, the extent of bending may differ between diagonals.

The controlled and carefully defined bending of the strands which is an essential feature of the present invention may be achieved in any suitable manner. Preferably we clamp opposite faces of the sheet with both ends of each strand to be bent held between the working faces of opposed bending tools adjacent the line about which bending is required.

In order to achieve the required simultaneous bending of the strands in each diagonal, the bending tools are preferably mounted on carrier bars, each bar carrying the tools acting upon a similar portion of the respective strands. Preferably one pair of bars carrying opposed tools remains fixed during the bending operation while another pair of bars is moved through an arc corresponding with the angle through which the ends of the strands are to be bent. Alternatively, a relative arcuate bending movement can be obtained by moving the respective pairs of carrier bars, one in the plane, and the other perpendicular to the plane, of the sheet.

The strands are preferably bent out of the sheet plane and perpendicular to their longitudinal direction. In this way the sheet after bending continues to extend in the same longitudinally extending path as the sheet before bending. However, perpendicular bending is not essential and if strands are bent at an angle to their longitudinal direction, the path of the bent sheet diverges from the longitudinal direction of the incoming sheet. In the latter form, the starting sheet is effectively expanded both in the plane, and perpendicular to the plane, of the starting sheet.

In the embodiment of the invention in which the strands are bent out of the sheet plane, each strand diagonal which is bent is separated from its adjacent bent strand diagonal by a diagonally extending unbent area, the plane of which remain parallel with the plane of the starting sheet.

The diagonally extending unbent area which separates the adjacent bent strand diagonals is also a strand diagonal of the original sheet but is formed from strands starting at the opposite end portions of the slots in adjacent rows. Where the plane of the starting sheet was horizontal, the expanded sheet so formed extends above or below the plane of the starting sheet.

In the embodiment of the invention in which the strand diagonals are bent within the plane of the sheet, the bent diagonals are separated by diagonally extending unbent areas comprising unbent strands and webs between longitudinally adjacent slots which lie parallel to each other. It will be appreciated that this formation is similar to that in the embodiment in which the strand diagonals are bent out of the plane of the sheet. The webs and unbent strands also lie parallel with the strands in the unexpanded sheet.

In addition to the effect of bending in or out of the sheet plane, the form of the mesh produced will depend on the relative slot lengths, the lateral spacing of the slots, the repetitive pattern of the slots, and the angle through which the strands have been bent. Generally the expanded meshes will show apertures which have four sides, opposite pairs of which are parallel.

The bending process described above may be performed by any appropriate mechanism. It is presently preferred to form the bends by turning each strand through an arc of the required extent to produce the required angle in the formed mesh. The resilience of the material normally results in some "spring-back" reducing the angle in the formed product when compared with the arc through which the strand has been bent. An alternative to bending the strand through an arc is to press each strand diagonal to provide the required amount of bending. However the bending operation is performed, the starting material is subject to relatively minor stresses and the slotted starting sheet may thus be provided with a desired finish prior to bending. This ability provides an important practical advantage in that a relatively flat slotted sheet is coated or otherwise finished far more readily than the relatively complex shape of an expanded mesh.

It might be expected that expanded sheet materials, produced as described above from a starting sheet in which the pattern of slots was such that the slots ran parallel to the sides of the starting sheet and the lines joining the ends of slots in alternate rows ran perpendicular to the sides of the starting sheet, would be formed with the sides of the expanded slots still running parallel with the sides of the expanded sheet. However it has been found that in such expanded sheets, the mesh pattern is skewed in relation to the sides of the sheets. This makes it desirable to trim the sides if the mesh is to be mounted against one or more perpendicular corners.

Applicant has found that in order to avoid trimming the sides of such mesh sheets, the pattern of slots in the starting sheet can be skewed, by forming the pattern with the slots running parallel to the sides of the starting sheet but with the lines joining the ends of slots in alternate rows not running perpendicular to the slots, to such an extent as to counter the skewing of the mesh pattern in relation to the sides of the expanded sheet. The angle at which the slots pattern must be skewed in order to avoid skewing of the mesh pattern is proportional to the angle through which the strand diagonals are bent.

The product formed by the process described above may optionally be subjected to further processing in accordance with another aspect of the present invention. The form of the products of the further processing is related to, but different from, the form of the products of the earlier processing. For convenience the two processing operations are referred to herein as "first stage" and "second stage".

The optional second stage procedure involves bending the previously unbent succession of parallel strand diagonals which intersect the strand diagonals bent in the first stage. The second stage bending procedure is preferably conducted in reverse direction to the first bending stage. The second stage bending may be conducted in a similar manner to the first stage bending but the degree of bending may differ. If desired, the first stage bending may be in the plane of the starting sheet and the second stage, out of this plane, or vice versa. For ease of production, the bending stages are preferably both in, or both out, of the plane of the sheet.

After first and second stage bending out of the sheet plane, web areas which were not involved in the overlap at the ends of adjacent slots remain in planes parallel to that of the starting sheet. After first and second stage bending in the plane of the sheet, web areas remain in alignment with the unbent sheet. The meshes formed after the second stage bending generally show apertures having six sides unless the first and second bending stages bent the strands perpendicular to the plane of the starting sheet.

Reference has been made above to the formation of a skewed pattern in the mesh produced by the first stage procedure. However, this phenomenon does not present a problem if the first stage product is subjected to the second procedure and the bending angle used in the latter procedure is the same as that in the first stage. The skew-forming effect of the first stage is countered by an oppositely acting effect in the second stage. It will be appreciated that this effect may be used, if desired, to further vary the range of product materials obtainable by use of the invention.

One preferred form of product formed by first stage bending consists of an expanded mesh product formed from a planar sheet which has been cut in a predetermined regularly repeated pattern comprising parallel rows each containing a plurality of slots with each slot in any one row partially overlapping at each end with a different slot in its laterally adjacent row or rows thus forming a plurality of strands consisting of the areas of overlap between adjacent rows of slots at each end of a respective slot, characterised in that each alternate strand diagonal consisting of the successive strands between a given end of a slot in a first row and the opposite end of the adjacent slot in the adjacent second row, between the other end of the said adjacent slot and the opposite end of the adjacent slot in the adjacent third row, and between opposite ends of similarly adjacent slots extending diagonally across the sheet, has been bent in succession with all strands in any one diagonal having been bent in two positions between the slots which define the sides of each strand, each strand in each strand diagonal having been bent in the same manner and to the same extent so that the strands of each strand diagonal which has been bent remain in substantially parallel planes.

The product formed by first stage bending can be subjected to second stage bending thereby forming a second preferred form of product in which the strand diagonals which intersect the said alternate strand diagonals have been bent in similar fashion to form an additionally expanded mesh product wherein the non-overlapping areas between adjacent slots in the sheet before bending remain in or parallel with the plane of said sheet.

The present invention further provides a machine which is capable of bending a slotted sheet in accordance with preferred forms of the process of the invention. In particular, the machine may enable first stage and optionally second stage bending out of the plane of a starting sheet.

The machine of the invention thus includes transport means capable of guiding and feeding a slotted starting sheet to a first stage bending station. The first stage bending station includes two sets of opposed carrier bars between each set of which the sheet can be fed by the transport means. Each carrier bar carries spaced bending tools and is arranged diagonally across the path of the sheet in alignment with the strand diagonals extending in a first direction across the sheet. The bending tools are located on each carrier bar in alignment with the respective strands which are to be bent.

Each set of carrier bars is operatively associated with an advance and retract mechanism so that at least one carrier bar from each set can be moved towards and away from its opposed carrier bar and the intervening sheet thus enabling the sheet to be clamped between the carrier bars when desired. At least one set of carrier bars is also operatively associated with a mechanism enabling limited bending movement of the sheet by the bending tools thus enabling selective bending of the sheet to form an expanded first stage product. Preferably, one set of carrier bars does not move in the bending step but the other set is operatively associated with a rotating mechanism enabling limited movement of both carrier bars in this set through arcs generally transverse to the plane of the sheet while the other set of carrier bars remains fixed.

Spaced from and following the first stage bending station, the machine of the invention may include a second stage bending station. The second stage bending station has corresponding essential components to the first stage bending station but the carrier bars of the two sets of opposed carrier bars of the second stage bending station (and the preferred transport means) are arranged in the reverse diagonal direction to the carrier bars of the first stage bending station. The second stage carrier bars and their associated bending tools are thus adapted to act upon the oppositely directed and previously unbent strand diagonals.

The diagrammatic drawings on the accompanying sheets illustrate specific forms of product which may be produced by following successively the first and second stage procedures of this invention. A diagram is also given to assist an understanding of the operation of a preferred form of machine. It is to be understood that these diagrams are given by way of example only to assist an understanding of the invention. In the drawings;

BRIEF DESCRIPTION OF THE DRAWING

FIG. 1 is a plan view of a sheet partly subjected to the first stage procedure;

FIG. 2 is a side elevation of the sheet of FIG. 1;

FIG. 3 is a plan view of the sheet of FIG. 1 partly subjected to the second stage procedure; and FIG. 4 is a side elevation of the sheet of FIG. 3.

DESCRIPTION OF THE PREFERRED EMBODIMENTS

Figure 1:
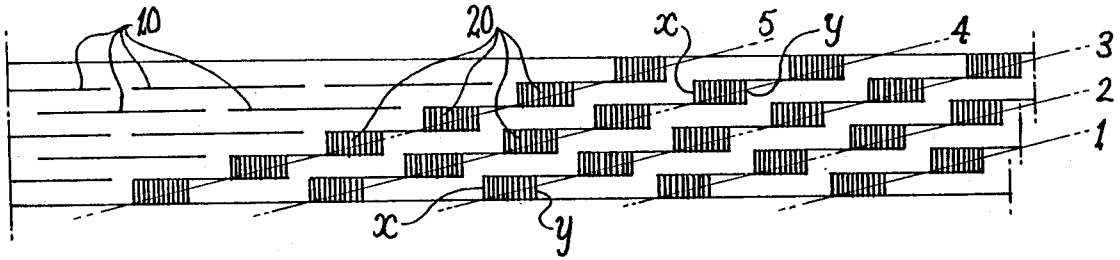
FIGS. 1 to 4 show bending out of the sheet plane.

In the sheet before bending as evident at the left hand end of FIG. 1, the pattern of slots 10 which extend in parallel rows along the sheet is apparent. Strands 20 are shown by shaded areas and extend across the sheet in parallel diagonals 1 to 5 marked by the broken lines in FIG. 1. Alternating strand diagonals (unshaded) separate strand diagonals 1 to 5 and run parallel with them.

Figure 2:
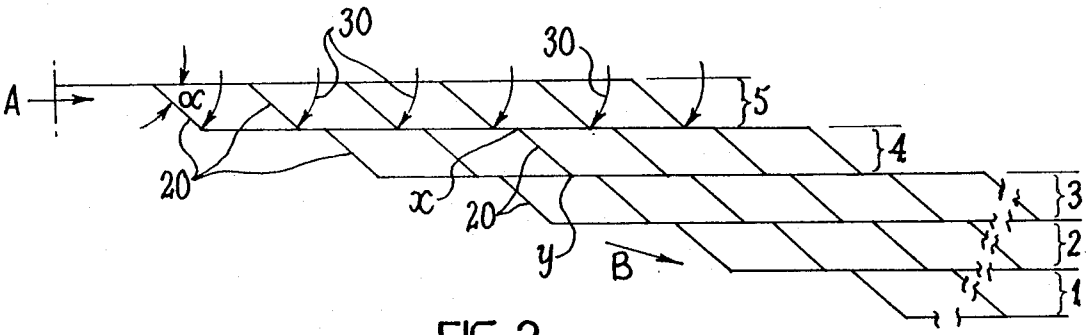

Strands 20 in diagonals 1 to 5 are each bent in succession about arcs 30 along lines x and y to expand the sheet below the plane of the starting sheet as seen in FIG. 2. The expansion angle $\alpha$ is shown as approximately 45° but may have any value from just over 0° to almost 180°.

It will be noted that strands 20 remain parallel with each other during and after bending. The alternating strand diagonals between the bent diagonals 1, 2, 3, 4 and 5 appear in FIG. 2 as straight lines as their planes after folding lie parallel with the plane of the starting sheet. FIG. 2 also shows the change from the horizontal infeed of arrow A to the downwardly inclined outfeed of arrow B, the inclination of the outfeed being dependent on the expansion angle $\alpha$ and on the slotting pattern. The mesh formed lies below the plane of the starting sheet.

Figure 3:
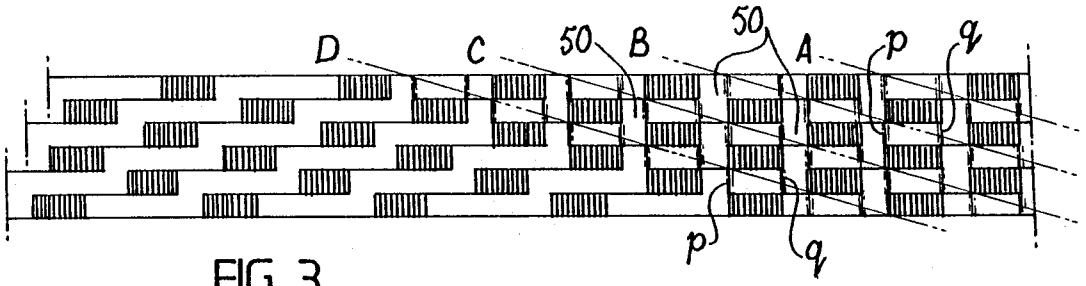
Figure 4:
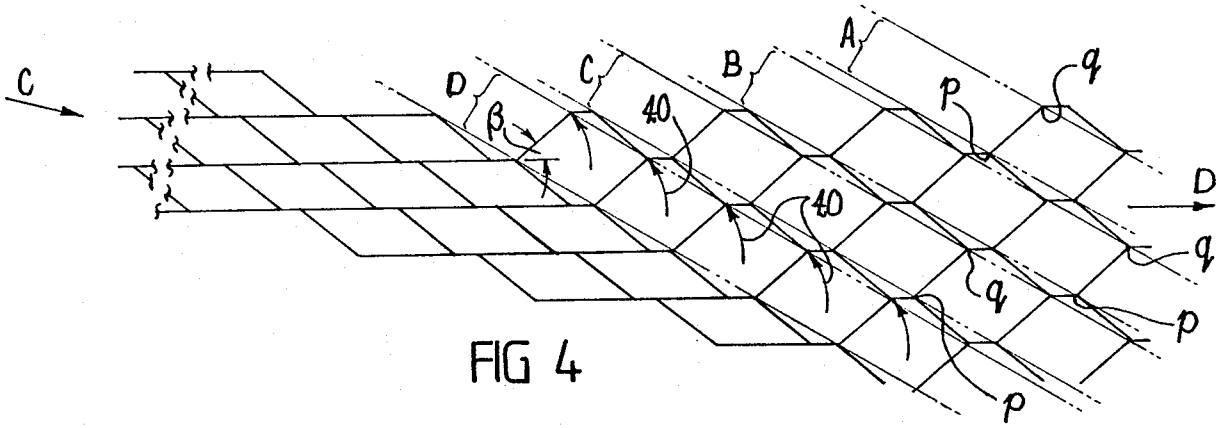
Figure 5:
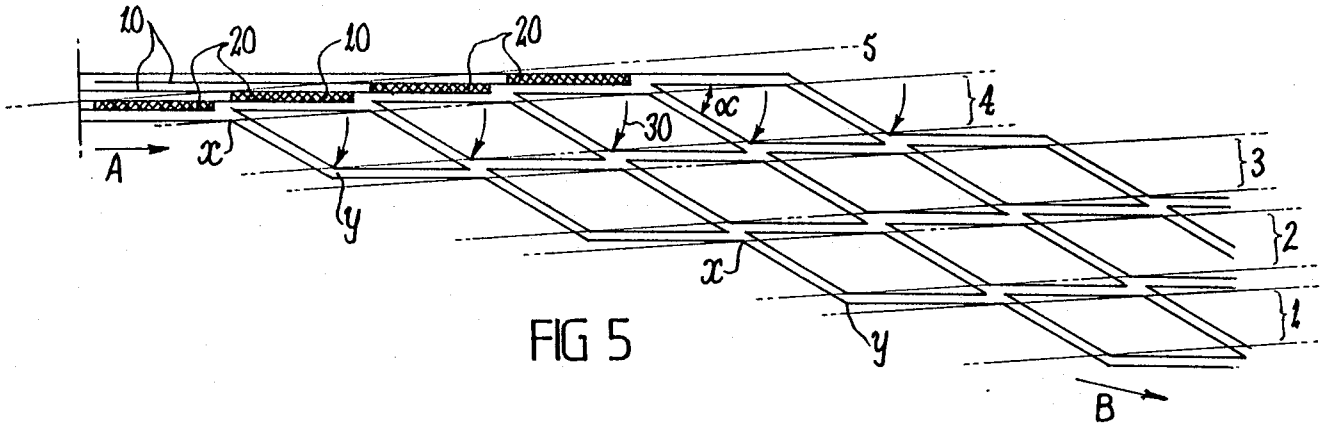
FIGS. 5 to 8 show bending in the sheet plane and are similar views to FIGS. 1 to 4 respectively.
Figure 6:
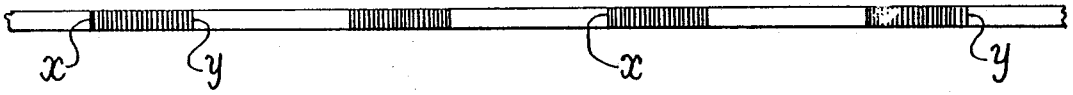
Figure 7:
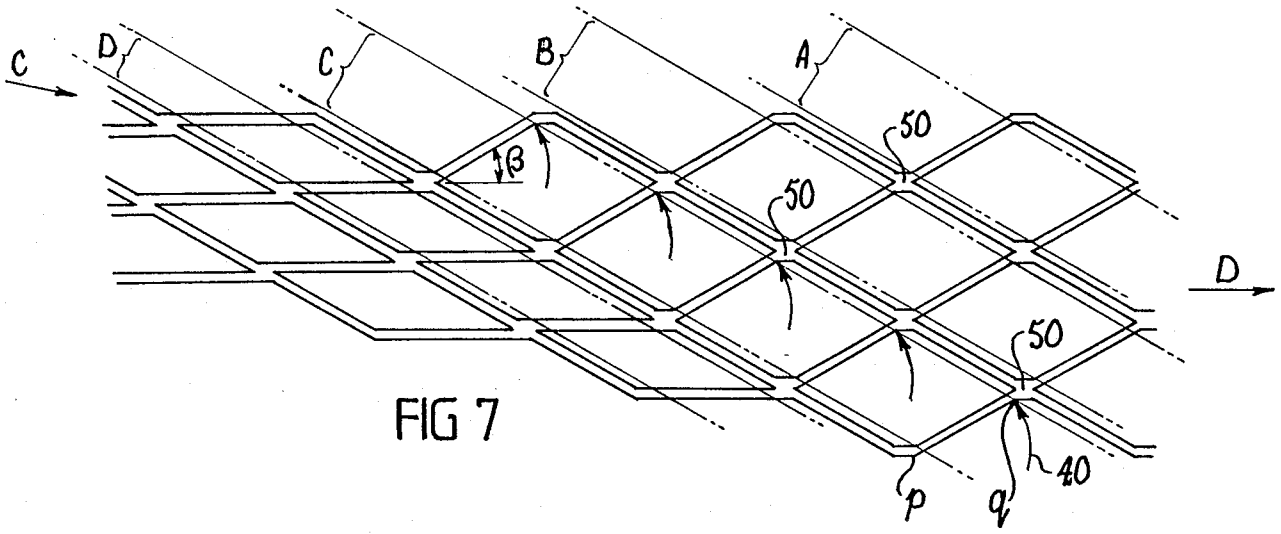
Figure 8:
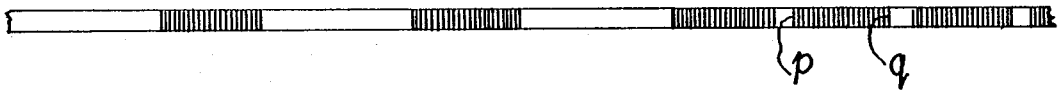

In the second stage, as illustrated in FIGS. 3 and 4, strand diagonals A, B, C and D extending transversely of the strand diagonals containing strands 20 are bent in succession about arcs 40 along lines p and q. The angle $\beta$ shown for the second stage procedure is the same as angle $\alpha$, forming a symmetrical mesh as seen in FIG. 4.

Web areas 50 between the ends of the strands bent in the first and second stage procedures are still in planes parallel to the plane of the starting sheet after the second stage procedure. As a result of the bending angles used in the illustrated embodiments the infeed angle for the second stage (arrow C) corresponds to the outfeed angle of the first stage but the equality of angle $\beta$ to angle $\alpha$ aligns the outfeed from the second stage (arrow B) parallel that of the first stage input.

As shown in the FIGS. 1 to 4, the bending of the strands about lines x, y and p, q is at 90° to the slots. This angle of bending is not essential but if used maintains the sheet path within straight parallel lines. The width of the incoming sheet material is not altered in plan view by either the first stage or second stage procedure as all expansion of the sheet extends in planes perpendicular to the plane of the starting sheet.

The illustrated embodiment of FIGS. 5 to 8 shows bending in the plane of the starting sheet. As is apparent from FIGS. 5 and 6, and FIGS. 7 and 8 respectively, all bending of the strands takes place in the plane of the sheet. The reference numbers and letters used in FIGS. 5 to 8 correspond to those in FIGS. 1 to 4 and similar operations to those described for FIGS. 1 to 4 apply to FIGS. 5 to 8.

In the embodiment of FIGS. 5 to 8, expansion takes place in the plane of the starting sheet and both the webs 50 and the strands 20 remain in the sheet plane throughout both stages. The bending angle $\alpha$ in this embodiment is shown as approximately 30°.

In the illustrated embodiments of FIGS. 1 to 4 and FIGS. 5 to 8 respectively, the slots formed in the starting sheet are all of equal length and are equally spaced both longitudinally and laterally. The pattern and type of pattern so formed are subject to a wide range of variation within the limitations described above. For example, not only may the relative slot lengths and spacing of the starting sheet be varied from that illustrated in FIG. 1 and FIG. 5, but the length of slots in alternate rows may be different, the longitudinal spacing of slots in alternate rows may be different, the lateral spacing of slots in alternate rows may be different, slots in alternate rows may be of different widths, and the web areas may be offset from the centre of the slots defining them. Many combinations of these variations are also possible.

The present invention thus provides a very versatile process which makes possible a wide variation in product forms. The stresses produced in the end products are relatively minor and hence the forces required to form the products and the power needed are less than in many known procedures.

Figure 9:
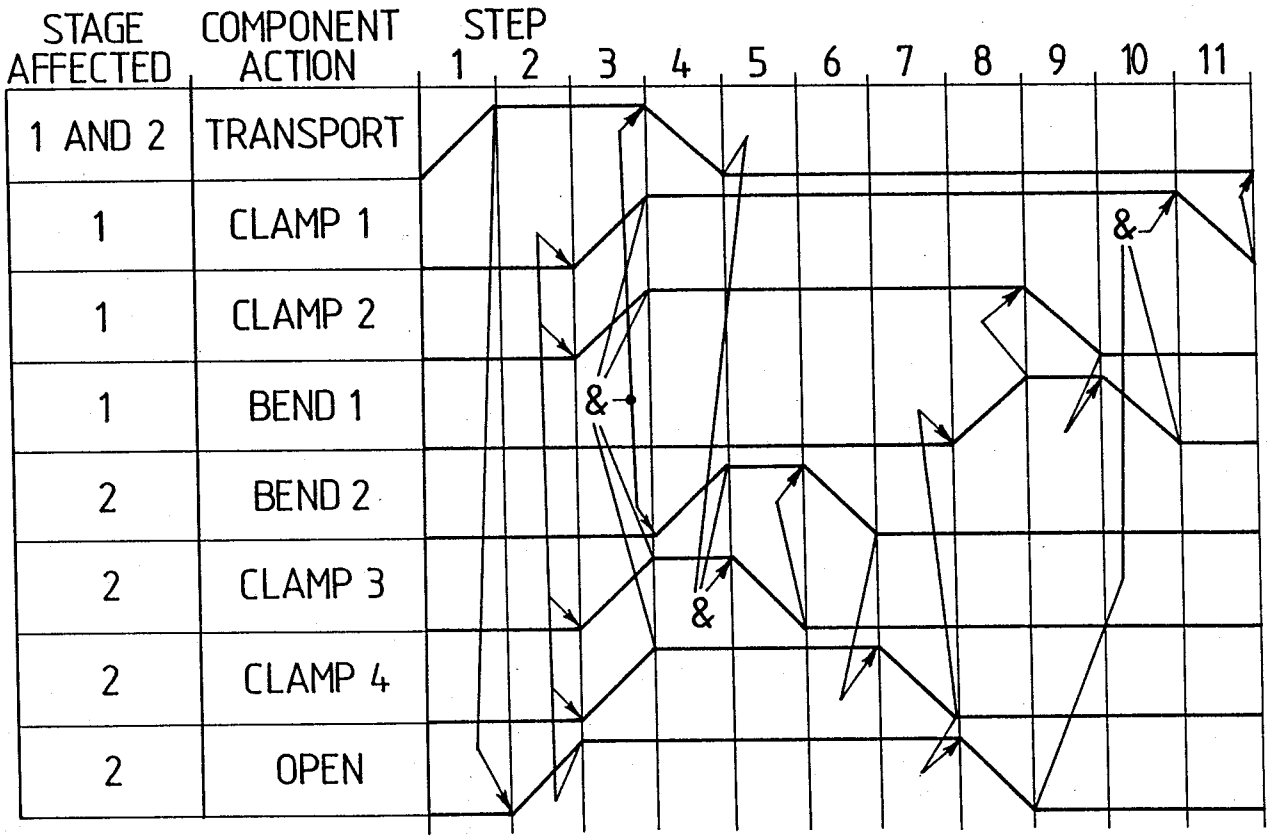
FIG. 9 is a chart illustrating a possible sequence of operation for the components of a preferred machine.

Before explaining the sequence of operations illustrated in FIG. 9, it is desirable to explain further features of the machine which has been developed as part of the present invention. In the preferred form of machine briefly referred to above, two bending stations are included. Although the following description will continue to refer to a single machine in which two bending stations are included, it is to be understood that the bending stations may be operated separately and may be physically separate in location.

Each bending station includes two sets of opposed tool carrier bars and transport means is provided at at least one bending station. The or each transport means preferably comprises a transport bar having associated transport fingers.

At each bending station one set of carrier bars (called hereafter the movable carrier bars) is movable as a set through limited arcs generally transverse to the plane of the sheet being formed in the machine. As indicated above, each carrier bar in both sets at each bending station carries spaced bending tools which are located on the bars in alignment with the respective strands of the sheet which are to be bent. Preferably the positions of the carrier bars and/or the tools they carry are adjustable or readily replaceable to enable adaption of the machine to different slot patterns on the sheet to be formed.

At least one carrier bar of each set of carrier bars at each bending station is associated with an advance and retract mechanism capable of driving the bar concerned towards and away from its opposed carrier bar and the intervening sheet during forming of the sheet. Preferably only one carrier bar of each set (hereafter called the clamping bar) is movable in this way. It should be understood that the sets of carrier bars (hereafter called the fixed carrier bars) which are not capable of arcuate movement during a bending step nevertheless also include at least one bar movable to clamp or release the sheet as required.

The sequence of operations illustrated in FIG. 9 is directed to the forming of an initially flat sheet material which has been slotted and which is formed by bending out of the plane of the sheet as described above, more particularly with reference to FIGS. 1 to 4. The machine used is of the type described above and which incorporates transport means at both first and second stage bending stations.

In FIG. 9, the action or actions for the components as indicated in the left-hand column take place in the stepped sequence indicated in the rest of the figure. Where a particular component has no action for a particular step, the heavy line for that component action line remains horizontal. Action by movement from one state to another is indicated by a rise or fall of the heavy line. The finer lines with arrow heads indicate the next step or steps taken after each step concludes. It will thus be seen that after the end of step 11, step 1 recurs and the cycle recommences. The passage of the finer lines through a junction with the symbol "&" indicates the inclusion of a safety mechanism which requires the completion of all the preceding actions linked to this junction before the next action or actions will commence.

In step 1, the transport bars at both bending stations engage the sheet and move it forward by a predetermined amount which brings the ends of selected strands into transverse alignment with the bending tools. The transport fingers are designed to engage the sheet at the forward end of an associated slot but as the slots have been partially expanded in the sheet reaching the second bending station, the form of the transport fingers may differ at each bending station. The transport fingers may be spring loaded to urge them into the slots or the entry may be achieved using the spring-like nature of the sheet being formed.

In step 2, the movable carrier bar set of the second stage bending station is moved to a "central" position in which the tools on one bar support the sheet material at the locations where further bending is to take place.

In step 3, the clamping bars of both movable and fixed carrier bar sets at both bending stations move towards their respective opposed carrier bars and clamp the sheet between the opposed tools at the bending locations. After all four clamping movements are completed, step 4 takes place.

In the illustrated sequence, step 4 involves two actions. The more important of these is the bending action at the second stage bending station. In this action the movable carrier bars are moved relative to the fixed carrier bars in an arc which produces the desired angle of bending at the ends of the previously unbent strands.

The other step 4 action is less important in that it need not take place at this step in the sequence. This action of moving the transport means into a return position may take place at any of steps 2 to 5 in the illustrated sequence.

After the step 4 actions are completed, step 5 releases clamping bar 3 which is the clamping bar forming part of the second stage fixed carrier bar set. Step 6 returns the movable carrier bars of the second stage bending station still clamped to the sheet, into a position in which the sheet is engaged by the transport fingers at this bending station.

In step 7, clamping bar 4 which is the clamping bar forming part of the second stage movable carrier bar set is released. Step 8 has two actions which may be independent. One action in step 8 as illustrated is the movement of the movable carrier bars at the first stage bending station to bend the sheet at that station. The other illustrated action in step 8 is the return of the second stage movable carrier bars to their transport position. This action may take place at any time in the illustrated sequence after step 7 and before step 1 is repeated.

In step 9, clamping bar 2 which is part of the movable carrier bar set at the first stage bending station is released. This action is followed by step 10, returning the movable carrier bars of the first stage bending station to their transport position. Finally, in step 11, the clamping bar of the fixed carrier bars at the first stage bending station is released and the sequence of actions can recommence.

It is to be noted that both the machine described above and the sequence of actions detailed for this machine are given by way of example only and are not to be taken as limiting the scope of the invention. In particular, other mechanisms can be designed to produce the bending actions at the locations on a slotted flat sheet as described above.

I claim:

1. A process for the formation of expanded mesh materials wherein a substantially planar starting sheet having a predetermined regularly repeated pattern comprising parallel rows each containing a plurality of slots with each slot in any one row partially overlapping at each end with a different slot in its laterally adjacent row or rows thus forming a plurality of strands consisting of the areas of overlap between adjacent rows of slots at each end of a respective slot, is fed in a stepwise manner through a machine in which each alternate strand diagonal consisting of the successive strands between a given end of a slot in a first row and the opposite end of the adjacent slot in the adjacent second row, between the other end of said adjacent slot and the opposite end of the adjacent slot in the adjacent third row, and between opposite ends of similarly adjacent slots extending diagonally across the sheet, is clamped between working faces of opposed bending tools and bent in succession with all strands in any one diagonal being bent simultaneously, with each strand being bent in opposite directions at each of two positions between the slots which define the sides of each strand, the strands so bent being moved through an arc having a radius corresponding to the distance between said two positions, each strand in each strand diagonal being bent in the same manner and to the same extent so that the strands of the strand diagonal being bent remain in substantially parallel planes during and after bending.

2. The process of claim 1 wherein the strands are bent in the sheet plane around axes which are perpendicular to the plane of the sheet.

3. The process of claim 1 wherein strand diagonals which are unbent and which intersect the bent strand diagonals after bending of said alternate strand diagonals are bent in succession with all strands in any one said unbent strand diagonal being bent simultaneously, with each strand being bent in opposite directions at each of two positions between the slots which define the sides of each strand, each strand in each said unbent strand diagonal being bent in the same manner and to the same extent so that the strands of the strand diagonal being bent remain in substantially parallel planes during and after bending.

4. The process of claim 3 wherein said unbent strand diagonals are clamped between working faces of opposed bending tools and then bent by being moved through an arc having a radius corresponding to the distance between said two positions.

* * * * *